US006035660A

United States Patent [19]

Craft

[11] Patent Number: 6,035,660

[45] Date of Patent: Mar. 14, 2000

[54] REFRIGERATED BEVERAGE MUG

[75] Inventor: Paul I. Craft, Fairbanks, Ak.

[73] Assignee: W.C. Linden, Inc., Dallas, Tex.

[21] Appl. No.: 09/123,132

[22] Filed: Jul. 27, 1998

[51] Int. Cl.[7] ..... F25D 3/00; F17C 13/00

[52] U.S. Cl. ..... 62/457.9; 62/293

[58] Field of Search ..... 62/457.1, 457.3, 62/457.4, 457.9, 48.3, 236, 293, 332

[56] References Cited

U.S. PATENT DOCUMENTS

| | | | |
|---|---|---|---|
| 2,805,556 | 9/1957 | Wang | 62/457.9 |
| 2,883,835 | 4/1959 | Pikey | 62/457.9 |
| 2,900,808 | 8/1959 | Wang | 62/294 |
| 2,973,632 | 3/1961 | Moore | 62/457.9 |
| 3,196,631 | 7/1965 | Holland | 62/457.9 |
| 4,054,037 | 10/1977 | Yoder | 62/224 |
| 4,058,384 | 11/1977 | Keefe | 62/457.9 |
| 5,115,940 | 5/1992 | Friedman | 220/737 |
| 5,421,159 | 6/1995 | Stokes | 62/3.64 |
| 5,555,740 | 9/1996 | Stevenson | 62/293 |
| 5,636,522 | 6/1997 | Ramos | 62/294 |

FOREIGN PATENT DOCUMENTS

| | | | |
|---|---|---|---|
| 1198354 | 7/1970 | United Kingdom | 62/457.9 |

*Primary Examiner*—William Doerrler

*Attorney, Agent, or Firm*—Gregory M. Howison; Mark W. Handley

[57] ABSTRACT

A refrigerated beverage mug is provided which includes a self-contained mechanical refrigeration unit which is powered by a power unit mounted onboard the beverage mug. The mechanical refrigeration unit is a closed loop system which is mounted to the beverage mug and includes a compressor, a condenser, an expansion flow passage and an evaporator. The condenser and the evaporator are integrally formed with the main body of the beverage mug. The compressor is mounted to the beverage mug for circulating a refrigerant through the condenser, the expansion flow passage and the evaporator. The power unit includes a chamber which contains a pressurized, expansible fluid such as liquid nitrogen, which is selectively released for passing through a pressure chamber of the compressor to power the compressor and the mechanical refrigeration unit. A manifold is integrally formed into the compressor housing for passing the expansible fluid from the compressor and across a portion of the condenser.

19 Claims, 7 Drawing Sheets

REFRIGERATED BEVERAGE MUG

TECHNICAL FIELD OF THE INVENTION

The present invention relates in general to beverage containers, and more particularly, to a refrigerated beverage mug having a self-contained mechanical refrigeration unit.

BACKGROUND OF THE INVENTION

Refrigerated beverages are typically kept in a refrigerated compartment, such as an ice chest or a conventional refrigerator, and maintained in a chilled state at a desired temperature for consumption. The refrigerated beverage is then removed from the refrigerated compartment and consumed while it is in the chilled state. A problem arises in that beverages may not be completely consumed prior to ambient temperatures heating the beverage above a desired temperature. In order to impede the rate of heat transfer from ambient air to chilled beverages, various types of insulated beverage containers have been provided. Insulation layers for beverage containers have been provided by expanded foam materials, vacuum chambers, and the like. Ice has also been used to absorb heat from beverages to both reduce and maintain the temperatures of the beverages. However, this usually results in dilution of the beverages caused by the water from the melted ice. Beverages are often purchased and stored at ambient temperatures, and often ice, ice chests or other type conventional refrigerated compartments are not readily available.

The prior art also includes freezer mugs, which are beverage containers that typically have refrigerant filled annular chambers. The refrigerant filled annular chambers are disposed between a beverage compartment and an exterior shell of such beverage containers. The freezer mugs are placed in refrigerated compartments to chill the refrigerant disposed in the annular chambers to a low temperature state for use as a heat sink for absorbing heat from a beverage placed within the freezer mug. Some of the freezer mugs have refrigerants which freeze when placed in a freezer type refrigerated compartment. After the refrigerant is sufficiently chilled, the freezer mugs are removed from the refrigerated compartment, beverages are placed in the beverage compartments thereof, and the chilled refrigerant absorbs heat from the beverages. However, a freezer compartment has to be readily available for freezer mugs to be of use.

Refrigerated beverage mugs have also been provided which have a cooling coils disposed around a drink compartment for passage of compressed gases released from cartridges. The compressed gases, after release from the cartridges, will expand and pass through the cooling coils to absorb heat from beverages disposed in the mugs. Expansion of the gases causes cooling of the beverages disposed in the mugs. The compressed gases were discharged to the atmosphere. The energy available during expansion of the compressed gases was not utilized to perform work, but rather to cool through expansion resulting from release of the gases from being in a compressed state within the cartridges to being in an expanded state at atmospheric pressures.

SUMMARY OF THE INVENTION

The present invention disclosed and claimed herein comprises a refrigerated beverage mug which includes a self-contained mechanical refrigeration unit that is powered by a power unit mounted onboard the beverage mug. The mechanical refrigeration unit is a closed loop system which is mounted to the beverage mug and includes a compressor, a condenser, an expansion flow passage and an evaporator. The condenser and the evaporator are integrally formed with the main body of the beverage mug. The compressor is mounted to the beverage mug for circulating a refrigerant through the condenser, the expansion flow passage and the evaporator. The power unit includes a chamber which contains a pressurized, expansible fluid such as liquid nitrogen or carbon dioxide, which is selectively released for passing through the compressor to power the mechanical refrigeration unit. A manifold is integrally formed into the compressor housing for passing the expansible fluid from the compressor and across a portion of the condenser.

In another aspect of the present invention, a portion of the condenser overlaps a portion of the evaporator to provide a common heat exchanger section in which heat is transferred from the condenser directly to a portion of the evaporator.

In still another aspect of the present invention, a diaphragm compressor is utilized to compress the refrigerant and circulate the refrigerant through the condenser, the expansion passage and the evaporator. The compressor includes a manifold control head having a shuttle valve for controlling operation of the manifold control head and the diaphragm pump type compressor.

In yet another aspect of the present invention, a release valve is mounted to the handle for selectively actuating to release the pressurized, expansible material for passing into a central housing core and powering the compressor to operate the mechanical refrigeration unit of the refrigerated beverage mug. The valve may be activated by a thumb operated lever or push button, or it may be actuated by a lever which forms the handle.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
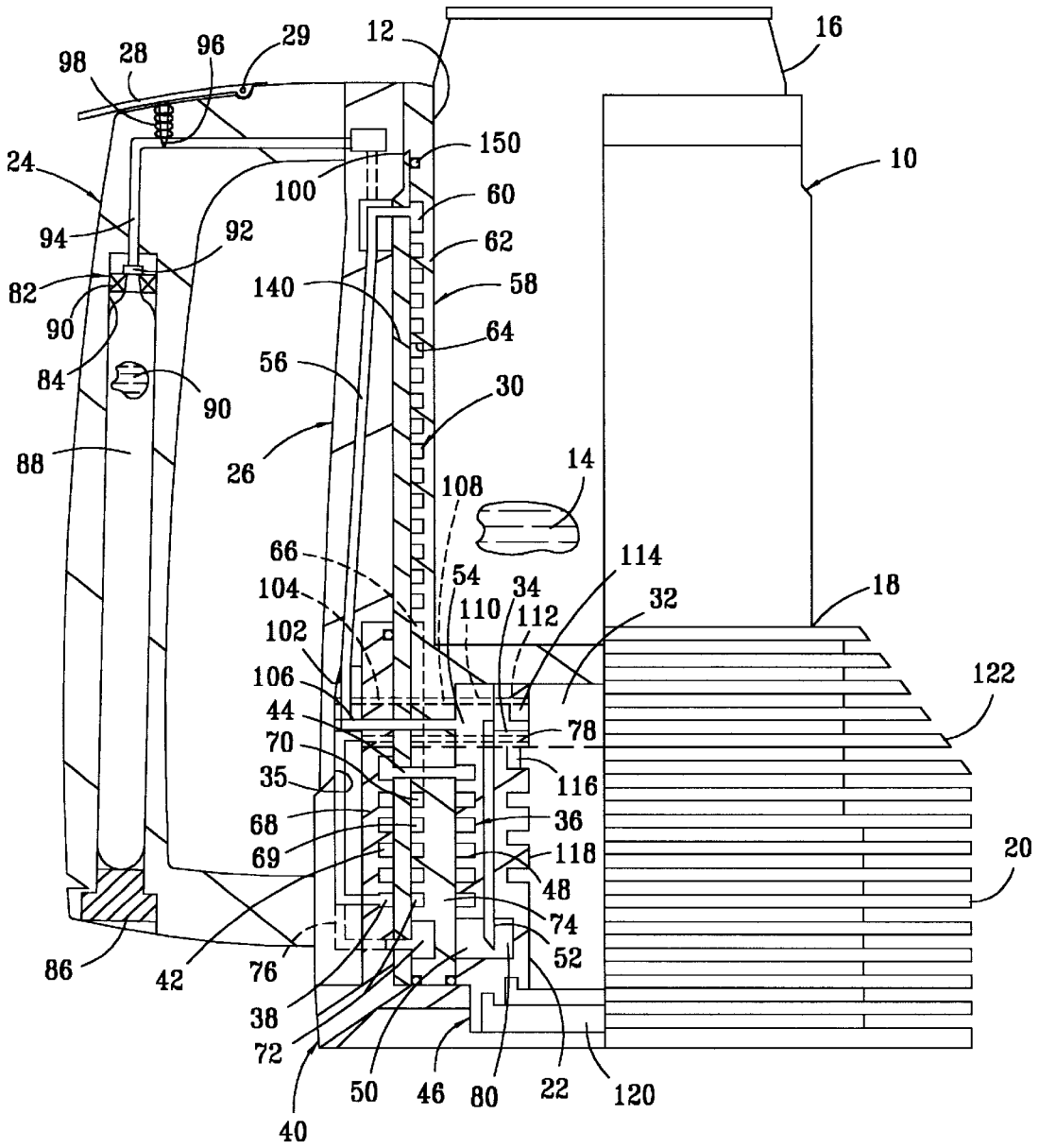
FIG. 1 illustrates a one-quarter, longitudinal section view of a refrigerated beverage mug incorporating the present invention.

Referring now to FIG. 1, there is illustrated a one-quarter, longitudinal section view of a refrigerated beverage mug 10. The refrigerated beverage mug 10 has a beverage compartment 12 for receipt of a beverage 14. The beverage 14 may be placed within the beverage compartment 12 while it is disposed within a conventional beverage container 16, such as an aluminum can, or the beverage 14 may be directly placed within the beverage compartment 12. The refrigerated beverage mug 10 has a main body section 18 which includes a base 20. The base 20 has an open bottom cavity 22. A handle 24 and handle mounting member 26 are mounted to one side of the main body section 18. A thumb operated actuator member 28 is proved by a lever which is pivotally mounted to the handle 24 by a pivot pin 29.

The refrigerated beverage mug 10 includes a self-contained mechanical refrigeration unit 30. The mechanical refrigeration unit 30 is mounted directly to the refrigerated beverage mug 10, and preferably forms an integral part thereof. The mechanical refrigeration unit 30 includes a compressor 32 to provide a motive means for moving a refrigerant fluid through the mechanical refrigeration unit 30. The compressor 32 has a compressor outlet 34 which is connected by a flow passage 35 to a condenser 36 at a condenser inlet 38. The condenser 36 includes an outer first condenser section 40. A spiraled annular flow passage 42 extends around the exterior periphery of the outer first condenser section 40 to define condenser flow paths which extend in coiled loops. A flow passage 44 connects an outlet of the outer first condenser section 40 to an inlet of an inner, second condenser section 46 of the condenser 36. The inner second condenser section 46 includes a spiral annular flow passage 48 which defines additional condenser flow paths which are interiorly disposed from the condenser flow paths which are defined by spiraled annular flow passage 42 of the outer, first condenser section 40. In some embodiments, instead of the spiral annular flow passages 42 and 48, a plurality of parallel, annular flow passages may be provided which connect to corresponding common header members on respective opposite ends thereof to provide parallel refrigerant flow passages. Such alternative flow passages may extend in one of or in a combination of circular, spiral, parallel or linear directions.

A lower refrigerant sump 50 is provided at the outlet of the inner condenser section 46. A riser tube 52 extends upward from a lower portion of the lower refrigerant sump 50 to an upper portion of an upper refrigerant sump 54. The lower end of the riser tube 52 extends downward to a lower portion of the lower refiigerant sump 50 such that it is submersed within liquid. An expansion passage 56 has a first end open defining an inlet from the upper refrigerant sump 54, preferably at a depth within the upper refrigerant sump 54 which is beneath an uppermost outlet end of the riser tube 52.

The expansion passage 56 connects the upper refrigerant sump 54 to an inlet 60 of an evaporator 58. The expansion passage 56 extends through the handle mounting member 26. The length and cross-sectional area of the bore of the expansion passage 56 are sized such that a refrigerant 80 flowing through the evaporative passage 56 will expand from a liquid state to gaseous state, lowering the temperature of the refrigerant such that cooling may be provided when the refrigerant 80 passes through the evaporator 58. The expansion passage 56 preferably has a circular cross-sectional area with a diameter that ranges in size from fifteen-thousandths (0.015) of an inch to sixty-thousandths (0.060) of an inch inside diameter, being fifteen-thousandths (0.015) of an inch in the preferred embodiment, and being approximately four (4.0) to five (5.0) inches in length. The expansion passage 56 is of an extended length type, extending in proximity to the refrigerant sump 54 and the inlet 60. Other embodiments of the present invention may incorporate expansion passages of a localized type, such as restricted flow orifices, expansion valves and the like.

The evaporator 58 includes an upper evaporator section 62, having the inlet 60. A spiral annular flow passage 64 defines an evaporator flow path which extends downward and around the upper evaporator section 62 in a spiral path. A flow passage 66 connects the outlet of the upper evaporator section 62 to a lower evaporator section 68. The lower evaporator section 68 has a spiraled annular flow passage 69 which defines an evaporator flow path which extends downward and around the upper evaporator section 62 in a spiral path, between an inlet 70 and an outlet 72 of the lower evaporator section 68. As an alternative to spiral annular flow passages 64 and 69, a plurality of parallel, annular flow passages may be provided which connect to respective common header members on respective opposite ends thereof to provide parallel refrigerant flow passages. Such alternative flow passages may also include flow passages which extend in one of or in a combination of circular, spiral, parallel or linear directions.

A common heat exchanger section 74 is defined by the lower evaporator section 68, the outer first condenser section 40 and the inner second condenser section 46. A flow passage 76 connects the outlet 72 of the lower evaporator section 68 to a compressor inlet 78. The upper evaporation section 62 and the lower evaporator section 68 together define the evaporator 58. Preferably, alcohol is used for the refrigerant 80. Other materials could also be utilized as refrigerants.

In operation, a refrigerant 80 is compressed by the compressor 32 and flows from the compressor 32 to the condenser 36. The refrigerant 80 will then pass through the condenser 36 and heat will be transferred to the ambient air and to a portion of the refrigerant 80 flowing through the lower evaporator section 68 of the evaporator 58 in the common heat exchanger section 74. The temperatures of the portion of the refrigerant 80 passing through the condenser 36 will be higher than the temperatures of the ambient air and the portion of the refrigerant 80 passing through the lower evaporator section 68. The refrigerant 80 will then pass from the condenser 36, into a lower refrigerant sump 50, and then upwards within the riser tube 52 to an upper refrigerant sump 54. Preferably, the refrigerant 80 will be in a substantially liquid state as it passes from the compressor 32, through the condenser 36 and into the lower refrigerant sump 50, through the riser tube 52 and into the upper refrigerant sump 54. The refrigerant will then flow through the extended expansion flow passage 56 where it will expand to a lower pressure state, reducing the temperature of the refrigerant go.

The refrigerant 80 will then flow from the expansion passage 56 and into the inlet 69 of the evaporator 58. Passage of the refrigerant 80 through the upper evaporator flow paths 64 will remove heat from the beverage 14 within the beverage compartment 12, reducing the temperature of the beverage 14. The refrigerant 80 will then pass into the common heat exchanger section 54 defined by the outer first condenser section 40, the inner second condenser section 46 and the lower evaporator section 58. Heat from the a higher temperature portion of the refrigerant 80, which is passing through the condenser 36, will be transferred to a lower temperature portion refrigerant 80, which is passing within the lower evaporator section 68. The refrigerant 80 will then pass from the lower evaporator section 68 and through the inlet 78 of the compressor 32 in preferably a gaseous state. The compressor 32 will preferably compress the refrigerant 80 into a substantially liquid state, raising the temperature of the refrigerant 80 for passing through the condenser 36. Thus, the mechanical refrigeration system is a closed loop type system, in which the refrigerant 80 is circulated through a closed loop which includes the compressor 32, the condenser 35, the expansion passage 56 and the evaporator 58.

A power unit 82 is provided for powering the mechanical refrigeration unit 30, preferably using a pressurized, expansible fluid 90. The power unit 82 includes a chamber 84 which is sealed by a retaining member 86. A cartridge 88 of expansible fluid 90 is preferably provided by a liquid nitrogen canister, which is initially pressurized to pressures in excess of 1800 pounds per square inch. In other embodiments, expansible fluids may be provided by other types of compressed or liquified gases, such as carbon dioxide and the like. The uppermost end of the cartridge 88 fits within and sealingly engages a packing 91. A tubular stem 92 extends into the cartridge 88 and passes through a seal disposed within the uppermost end of the cartridge 88. The tubular stem 92 is hollow to provide a flow passage between the interior of the cartridge 88 and a flow passage 94. A needle valve 96 is operable to selectively allow flow of the expansible fluid 90 through the flow passage 94. The needle valve 96 includes a spring biasing member 98, which urges the needle valve 96 into a closed position. The actuator member 28 is thumb actuated to push downward on the needle valve 96, overcoming the bias of the spring 98 and allowing flow of the expansible fluid 90 through the flow passage 94 when depressed.

The flow passage 94 connects to a flow passage 100 which extends longitudinally through a portion of the handle mounting member 26. The flow passage 100 may be sized of a cross-sectional area and length to provide an extended length type of expansion passage for the expansible fluid 90, and control the rate of flow therethrough according to a maximum terminal velocity for metering flow of the expansible fluid 90 into the compressor 32, similar to the expansion flow passage 56 for the refrigerant 80. Alternatively, a localized restriction type of flow passage may be provided to control the flow of the expansible fluid 90, such as a metering orifice which chokes the flow of the expansible fluid 90 into the compressor 32. A lower end of the flow passage 100 connects to a chamber 102. Flow passages 104, 106, 108 and 110 interconnect various portions of the main body section 18 of the refrigerated beverage mug 10 for interconnecting the chamber 102 and a power inlet 112 of the compressor 32 for passing the expansible fluid 90.

The compressor 32 has an outlet 114 which connects to a plurality of flow ports 116 for passing the expansible fluid 90 from within the compressor 32 and over a finned surface of the open bottom cavity 22 of the base 20 of the refrigerated beverage mug 10. The surface of the open bottom cavity 22 is herein considered a finned surface since it has a plurality of grooves formed therein to provide an increased thermal transfer surface area of the surface of the open bottom cavity 22 for increasing heat transfer therethrough. The outlet 114 circumferentially extends around the compressor 32 and the flow ports 116 are formed into the sides of the compressor 32 to together define a manifold for distributing the expansible fluid 90 around the finned surface 118 of the open bottom cavity 23. The open bottom cavity 22 has a bottom opening 120.

In operation, a cartridge 88 of the expansible fluid 90 is loaded within the chamber 84 of the handle 24. The retaining member 86 is then threadingly engaged with a lower threaded section of the chamber 84. The cartridge 88 will be pushed onto the tubular stem 92, with the top of the cartridge 88 inserted within the packing 91 to sealingly engage between the interior walls of the chamber 84 and the exterior periphery of the upper portion of the cartridge 88. The tubular stem 92 will then pass the expansible fluid 90 from within the cartridge 88 to the flow passage 94.

When cooling of the beverage 14 is desired, the actuator member 28 is preferably pushed downward by the thumb of a user of the refrigerated beverage mug 10, operating the needle valve 96 to allow flow of the expansible fluid 90 through the flow passage 94 and into the flow passage 100 in the handle mounting member 26. When it is desired to stop flow of the expansible fluid 90 from the cartridge 88, the outward end of the actuator member 28 is released, and the bias spring 98 will urge the actuator member 28 upwards to close the needle valve 96 and prevent flow of the expansible fluid 90 through flow passage 94.

The expansible fluid 90 will then pass through the chamber 102 and the flow passages 104, 106, 108 and 110 and into the power intake 112 of the compressor 32. Passage of the expansible fluid 90 through the compressor 32 will power operation of the compressor 32, to compress the refrigerant 80 and power passage of the refrigerant 80 through the condenser 36, the expansion flow passage 56 and the evaporator 58 of the mechanical refrigeration unit 30. The expansible fluid 90 will pass from the outlet 114 of the compressor 32, through a flow port 116 and across the finned surface 118 of the open bottom cavity 22 of the base 20. The expansible fluid 90 will then pass through the bottom opening 120 and into the atmosphere, mixing with ambient air. The expansible fluid 90 will expand, preferably from a substantially liquid to a substantially gaseous state, when passing from the cartridge 88, through the flow passages 100, 104, 106, 108 and 110, and through the compressor 32. Expansion of the expansible fluid 90 will lower its temperature. Thus, passing the expansible fluid 90 across the finned surface 118 will provide additional cooling for the inner, second condenser section 46 above that which would be provided by ambient air only.

The base 20 of the main body section 18 includes a ventilated outer cover 122 such that the user's hand may be protected from touching the exterior surfaced of the outer first condenser section 40, and such that air may pass over the exterior of the outer first condenser section 40 for transferring heat from the outer first condenser section 40 to the ambient air.

Figure 2:
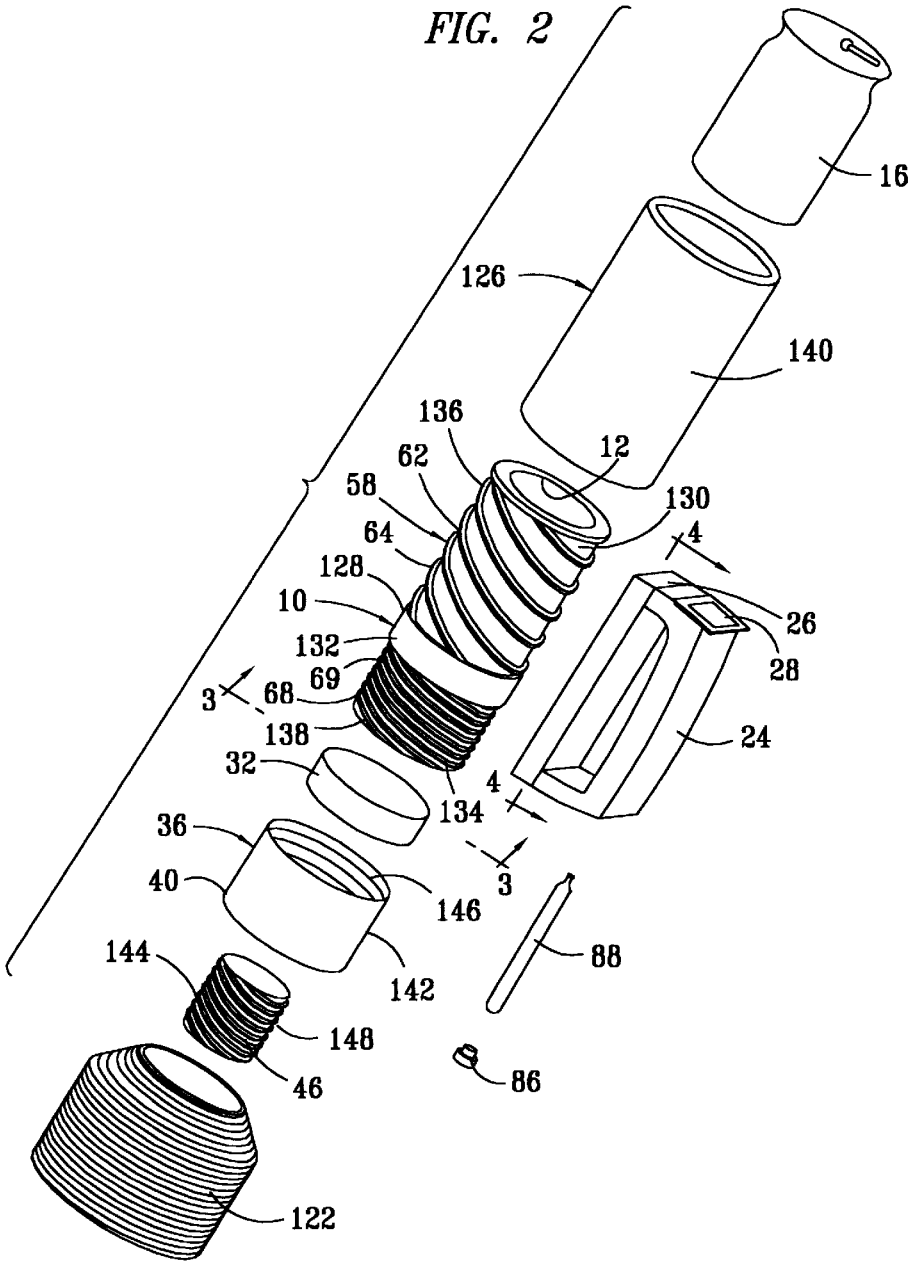
FIG. 2 illustrates an exploded view of the refrigerated beverage mug and a container for a beverage.

Referring now to FIG. 2, there is illustrated an exploded view of the refrigerated beverage mug 10. The refrigerated beverage mug 10 has a housing 126 which includes a core member 128. The core member 128 has a cup portion 130, an intermediate portion 132 and a lower tubular portion 134. The cup portion 130 is an upper cylinder having a closed end and an interior surface which defines the beverage compartment 12. The beverage compartment 12 is sized such that it will easily receive a conventional beverage container 16 in a sliding engagement, with at least a portion of the walls of the beverage compartment 12 contacting the sides of the container 16, such that the evaporator 58 is in thermal communication with the beverage 14 within the container 16 for transferring heat therebetween. The intermediate portion 122 provides flow passages for connecting various components of the mechanical refrigeration unit 30. The lower tubular portion 134 defines a lower cylinder with an open lower end. Preferably, grooves 136 are formed into the exterior surface of the cup portion 130 and grooves 138 are formed into the lower tubular portion 134 to define the evaporator flow paths 64 of the upper evaporator section 62 and the evaporator flow paths 69 of the lower evaporator section 68, respectively. The interior surface of the tubular portion 134 is provided with a smooth finish.

The housing 126 further includes an outer sleeve 140 for extending over the core member 128. Preferably, the interior bore of the outer sleeve 140 closely fits the exterior surface of the core member 128 such that adjacent ones of the grooves 136 and adjacent ones of the grooves 138 will not have significant fluid communication therebetween when the refrigerant fluid 80 is passing therethrough, to allow operation of the mechanical refrigeration unit 30. The exterior of the outer sleeve 140 closely fits over raised portions exterior periphery of the exterior of the core member 128. An outer condenser sleeve 142 fits exteriorly around the lowermost portion of the outer sleeve 140. An inner condenser sleeve 144 fits within the interior bore of the lower tubular portion 134 of the core member 128. Preferably, the interior bore of the outer condenser sleeve 142 fits closely against the exterior of the lower portion of the outer sleeve 140 such that adjacent ones of the grooves 146 which are formed into the interior bore of the outer condenser sleeve 142 will not have significant communication of the refrigerant 80 therebetween, to allow operation of the mechanical refrigeration unit 30.

Raised portions of the exterior surface of the inner condenser sleeve 144 preferably fit closely with the interior bore of the lower tubular portion 134 of the core member 128 such that the spiraled grooves 128 formed into the exterior surface of the inner condenser sleeve 144 will not have significant fluid communication therebetween, allowing operation of the mechanical refrigeration unit 30. The grooves 148 preferably provide the flow passages 44 of the outer, first condenser section 40. The grooves 148 formed into the interior surfaces of the inner, second condenser sleeve 144 preferably provide the condenser flow paths of the spiraled annular flow path 48 of the inner, second condenser section 44. Preferably, the grooves 136, 138, 146 and 148 are provided by an Acme screw threads. The grooves 136, 138, 146 and 148 may be provided by adjacent, parallel spiral grooves, which may be of different or of variable pitches.

Seals 150 are provided for sealingly engaging between various portions of the core member 28, the outer sleeve 140, the outer condenser sleeve 142, the inner condenser sleeve 144 and the manifold means provided by the handle mounted member 26. The seals 150 may be provided by elastomeric O-rings, gaskets, as well as seals of other types of materials, and may alternatively be integrally formed with portions of the housing 126.

The compressor 32 is preferably provided as a separate unit from the housing 126. The compressor 32 has an exterior, preferably circumferential periphery, which fits closely within the interior surface of the inner condenser sleeve 144. Preferably, the upper portion of the inner condenser sleeve 144 has a smooth bore. The ventilated outer cover 122 fits around the exterior of the outer condenser sleeve 144. The handle mounting member 28 will be mounted directly to the outer sleeve 140. The handle 24 is then mounted to the handle mounting member 28.

Figure 3:
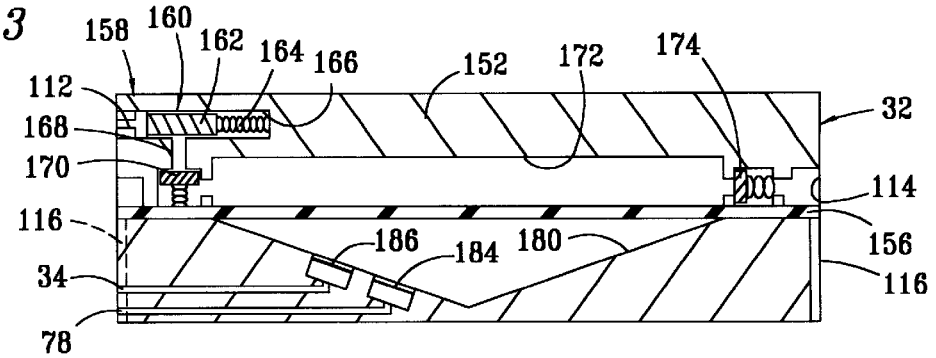
FIG. 3 illustrates a sectional view of a compressor for the refrigerated beverage mug, taken along Section line 3—3 of FIG. 2.

Referring now to FIG. 3, there is illustrated a sectional view of the compressor 32, taken along section line 3—3 of FIG. 2. The compressor 32 includes an upper housing 152 and a lower housing 154 with a flexible diaphragm member 156 extending therebetween. The diaphragm member 156 is preferably formed of elastomeric materials. A control head 158 is mounted in the upper portion 152 of the housing of the compressor 32. The control head 158 includes a shuttle valve 150 for controlling operation of flow of the expansible fluid through the compressor 32. The shuttle valve 160 includes a piston 162 that is responsive to a biasing member provided by a spring 164. The piston 162 and the biasing member 154 are disposed within a cylinder 166 formed into the upper portion 152 of the housing of the compressor 32. A flow port 168 extends into the side of the cylinder 160. The first end of the cylinder 166 is in communication with, and is preferably defined by, the power inlet 112 of the compressor 32. A flow passage controls flow of the expansible fluid 90 into the power inlet 112, which may be an extended flow passage, such as the flow passage 100 discussed above, or a localized flow passage, such as a metering orifice, and the like.

An inlet valve 170 allow passage of the expansible fluid 90 into the flow port 168 in one direction only. Preferably, the inlet valve 170 is provided by a spring biased check valve. The outlet end of the inlet valve 170 is connected to a pressure chamber 172. An outlet valve 174 is provided by a spring biased check valve to allow flow from the pressure chamber 172 in one direction only, and only when the pressure within the pressure chamber 172 drops beneath a predetermined value. The outlet valve 174 is connected to the power outlet 114 of the compressor 32.

In other embodiments of the present invention, the outlet valve 174 may be provided by utilizing the piston 162 of the shuttle valve 160 to block a second flow port (not shown) extending between the pressure chamber 172 and the interior bore of the cylinder 166, yet separated from the power inlet 112 and the flow port 168 by the piston 162 always separating the second flow port (not shown) from the power inlet 112 and the flow port 168, preventing substantial fluid communication therebetween such that the compressor 32 is operational. The piston 162 will block the second flow port (not shown) at times when the flow port 168 is open and in communication with the power inlet 112. When the flow port 168 is sealed from being in substantial communication with the power inlet 112, the second flow port (not shown) would then be in communication with a port (not shown) connecting the inward portion of the cylinder 166 with the flow ports 116 to allow discharge of the expansible fluid from within the compressor 32.

Referring still to FIG. 3, the lower housing 154 has a conically shaped cavity formed in the upper face thereof which defines a pump chamber 180. The pump chamber 180 is connected to an inlet valve 184 and an outlet valve 186, which preferably are provided by reed type valves. The inlet valve 184 allows substantial flow in one direction only, which extends through the inlet 78 and into the pressure chamber 180. The outlet valve 186 allows substantial flow in one direction only, which extends from within the pump chamber 180 and through the outlet 34 of the compressor 32.

Figure 4:
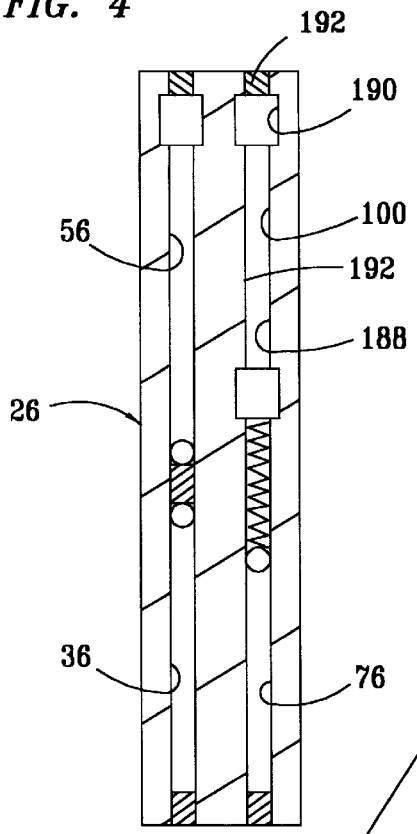
FIG. 4 illustrates a sectional view of a manifold section of a handle mount of the refrigerated beverage mug, taken along Section line 4—4 of FIG. 2.

Referring now to FIG. 4, there is illustrated longitudinal section view of the handle mounting member 26, taken along section line 4—4 of FIG. 2. The handle mounting member 26 provides a manifold member having interior flow passages extending therein. Preferably, the flow passages 36, 56, 76 and 100 are provided by two spaced apart grooves 188. The two grooves 188 may be of variable width, such that a single one of the grooves 188 may have changes in the size of its cross-sectional area as it extends longitudinally across the length of the handle mounting member 26. The grooves 188 may be formed into the face of the handle mounting member 26, or may be provided by holes which are bored through interior portions of the handle mounting member 26. Cavities 190 provide large opening portions to provide larger tolerances for interconnecting the respective ones of the grooves 188 of the handle mounting member 26 to other mating flow passages of the refrigerated beverage mug 10. Plug members 192 are provided for selectively positioning into fixed positions within various ones of the two grooves 188 defining the flow passages 36, 56, 76 and 100, to terminate the flow passages 36, 56, 76 and 100 in the appropriate positions relative to interconnecting flow ports of the housing 126.

In operation, a beverage 14 is placed within the beverage compartment 12, either directly within the beverage compartment 12 or within a beverage container 16, which is placed within the beverage compartment 12. Then, the actuator member 28 is preferably pressed by a thumb of a user's hand which is gripping the handle 24. Pressing the actuator member 28 releases the expansible fluid 90 from within the cartridge canister 88 to power the compressor 32 of the mechanical refrigeration unit 30. Powering the compressor 32 causes the compressor 32 to circulate the refrigerant 80 through the condenser 36, through the expansion flow passage 56, into the evaporator 58 and back into the compressor 32. The refrigerant 80 will pass through the evaporator 58, cooling the beverage 14 disposed within the beverage compartment 12. The expansible fluid 90 is released from the compressor 32, passes through flow ports 116, and passes across an inner, second condenser section 46 to remove heat from the condenser section 46. The refrigerated beverage mug 10 may be used to cool the beverage 14 from ambient temperatures to desired temperatures, such as forty degrees Fahrenheit and below.

Figure 5:
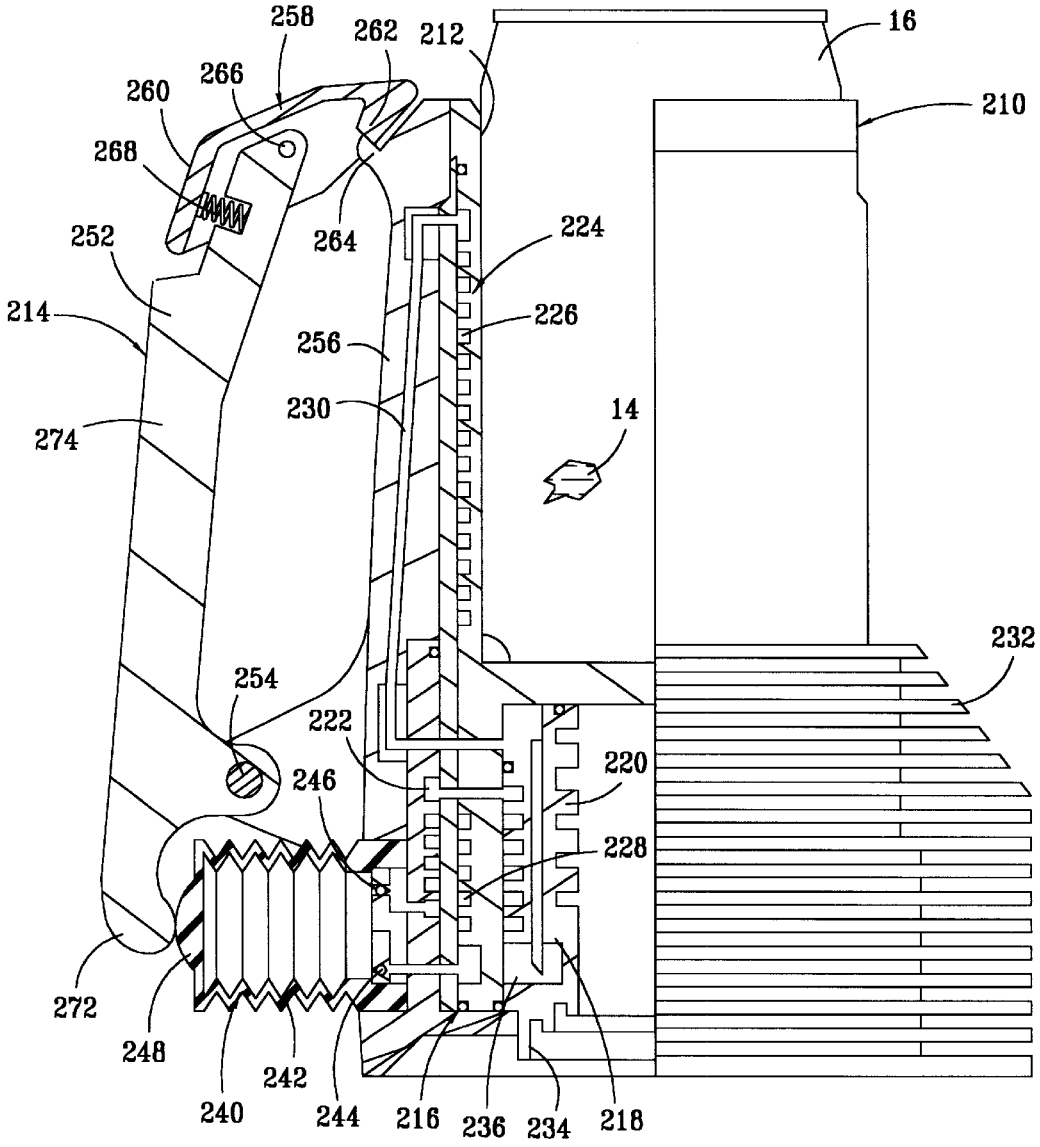
FIG. 5 illustrates a one-quarter, longitudinal section view of refrigerated beverage mug of a first alternative embodiment of the present invention.

Referring now to FIG. 5, there is illustrated a one-quarter, longitudinal section view of an alternative refrigerated beverage mug 210. The refrigerated beverage mug 210 has a beverage compartment 212 in which a beverage 14 may be placed either directly or while being contained within a conventional beverage container 16, such as an aluminum can, which contains the beverage 14. The beverage compartment 212 is sized for receiving the beverage container 16, such that walls of the beverage compartment 212 closely fit against the exterior of the beverage container 16 for absorbing heat transferred therefrom. The refrigerated beverage mug 210 has a pump handle 214 and a mechanical refrigeration unit 216. The mechanical refrigeration unit 216 is a closed loop type refrigeration system, similar to the mechanical refrigeration unit 30 of the refrigerated beverage mug 10. The mechanical refrigeration unit 216 includes a condenser 218 having a first inner condenser section 220 and a second outer condenser section 222. An evaporator 224 has an upper evaporator section 226 and a lower evaporator section 228. An expansion flow passage 230 is provided for interconnecting the condenser 218 to the evaporator 224. A ventilated outer cover 232 extends around the condenser 218, and the refrigerated beverage mug 210 has an open, lower end 234 which exposes the inner first condenser section 220 to ambient air. Preferably, alcohol is used as a refrigerant 236 for circulating through the mechanical refrigeration unit 216. The refrigerated beverage mug 210 is substantially similar to the refrigerated beverage mug 10, except that the pump handle 214 and a compressor 240 are used with the refrigerated beverage 210. The components of the alternative refrigerated beverage mug 210 are formed to integrally provide components of the mechanical refrigeration unit 216, and are similar to those of the refrigerated beverage mug 10, except for changes in positioning of flow passages and flow ports to accommodate the power source provided by the pump handle 214 and the compressor 240.

The compressor 240 is preferably provided by a bellows-type pump which includes an elastomeric bellows 242. An inlet valve 244 will allow substantial flow in one direction only, into the bellows 242 of the compressor 240. An outlet valve 246 will allow flow in one direction only, out of the bellows 242 of the compressor 240, after a desired discharge pressure from the compressor 240 is attained by compressing the bellows 242. A push surface 248 is provided for pressing against to push the bellows 242 inwardly towards the inlet valve 244 and the outlet valve 246. The bellows 242 is preferably formed of elastomeric materials, such that the push surface 248 of the bellows 242 will return to an outward position, spaced apart from the inlet valve 244 and the outlet valve 246, when external forces pressing inward against an outward face of the push surface 248 are released.

The pump handle 214 is manually operated to provide a power source for powering the compressor 240 of the mechanical refrigeration unit 216. The pump handle 214 includes a grip 252 which provides a hand grip when utilizing the refrigerated beverage mug 210, both for holding the mug during use to consume the beverage 14 and for use as a lever arm for operating to push the push surface 248 of the compressor 240 inward toward the valves 244 and 246 to power the mechanical refrigeration unit 216. The grip 252 is connected by pivot pin 254 to the lower end of a handle mounting member 256. A latch 258 is provided on the upper end of the grip 252. The latch 258 includes a thumb tab 260 having a clasp 262 disposed on one end thereof The clasp 262 engages a catch shoulder 264 of the latch 258, formed into the upper end of the handle mounting member 256. A pivot pin 266 connects the thumb tab 266 to the upper end of the grip 252. A bias spring 268 urges one end of the thumb tab 260 outward, such that the clasp 262 will remain engaged with catch shoulder 264 during use.

An pusher arm 272 extends downward from the lower portion of the grip 252 which is located beneath the pivot pin 254. A much longer section, a lever section 274 of the grip 252 extends upward, on an opposite side of the pivot pin 254 from the pusher arm 272, to provide mechanical advantage in gripping and pivoting the grip 252 about the pivot pin 254 to cause the pusher arm 272 to urge the push surface 248 of the bellows 242 inwards, towards the inlet valve 244 and the outlet valve 246.

In operation, a user will place a beverage 14 within refrigerated beverage mug 210. When cooling of the beverage 14 is desired the thumb tab 260 will be depressed to release the clasp 262 from the latch shoulder 264. Then, the refrigerated beverage mug 210 may be gripped in one hand of the user, and the lever section 274 may be gripped in the other hand of the user. The lever section 274 will be pulled in a first angular direction in a compression stroke, such that the clasp 262 is separated from the catch shoulder 264 and the pressure arm 272 urges the pressure surface 248 of the compressor 240 inward, toward the valves 244 and 246, compressing the refrigerant 80 within the bellows 242. The refrigerant 80 will be compressed within the bellows 242 until a predetermined discharge pressure is achieved within the bellows 242, and then the outlet valve 246 will open and the refrigerant 80 will be discharged therethrough at the predetermined discharge pressure. After the lever 274 is fully stroked on the above compression stroke, then the lever 274 will be pushed in an opposite angular direction to the first angular direction in a release stroke, such that the clasp 262 is moved closer to the latch shoulder 264. This moves the pressure arm 272 outward and away from the push surface 248, and then the elastomeric bellows 242 of the compressor 240 will elastically expand to urge the push surface 248 outward, away from the inlet valve 244 and the outlet valve 246. This pumping action will be repeated until the beverage 14 is cooled to a sufficiently low temperature for consumption.

Figure 6:
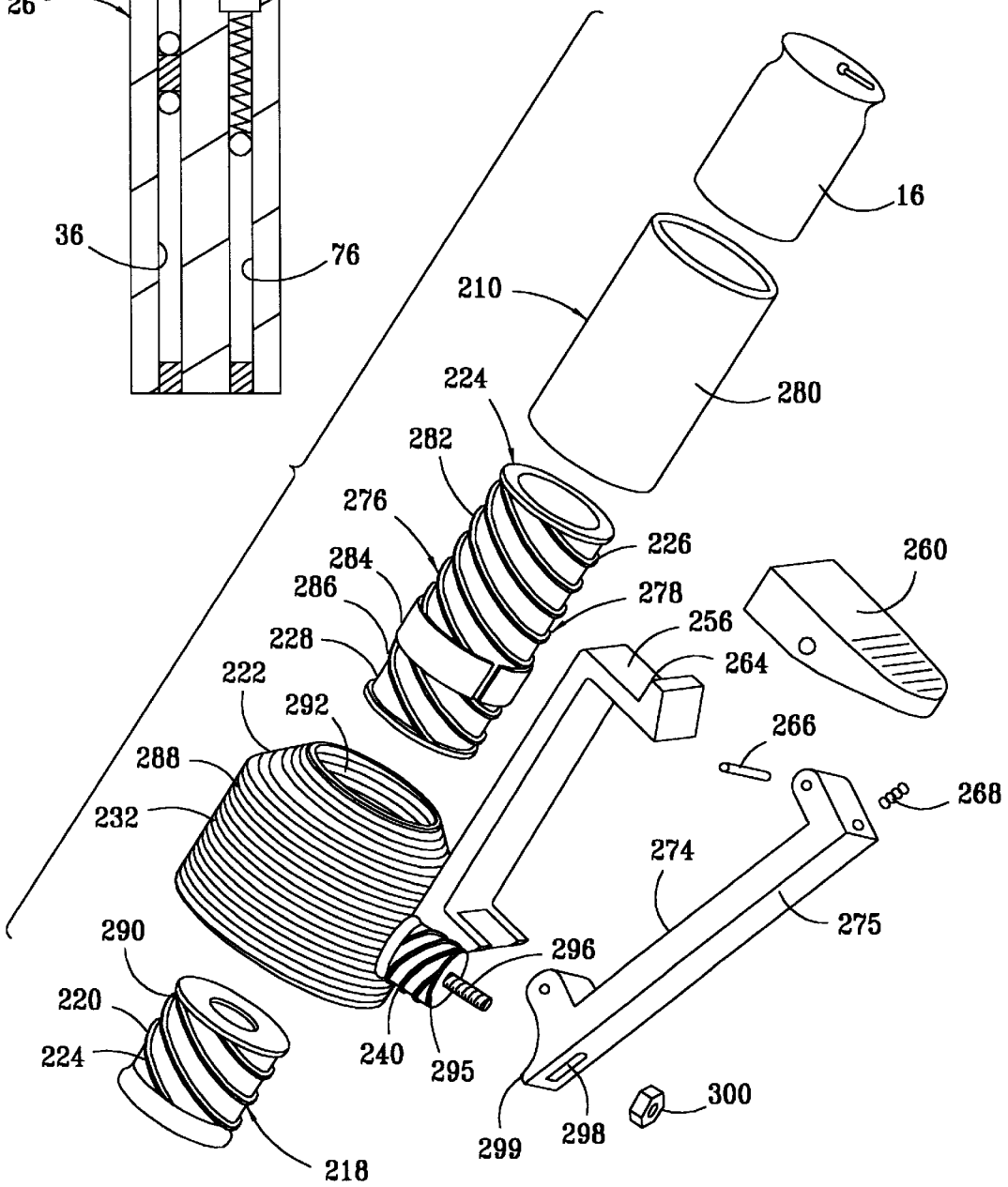
FIG. 6 illustrates an partially exploded view the refrigerated beverage mug of the first alternative embodiment to the mug depicted FIG. 5.

Referring now to FIG. 6, there is illustrated an partially exploded view of the refrigerated beverage mug 210, with an alternative grip handle 275. The refrigerated beverage mug 210 includes a housing 276 having a main body section 278 and an outer sleeve 280 which fits closely over the main body section 278. The main body section 278 has a cup sized for receipt of a standard size beverage container 16, such as an aluminum can. The main body section 278 of the housing 276 includes an upper cup portion 282, an intermediate portion 284 and a lower portion 286. The exterior surface of the upper portion 282 of the housing 276 has grooves 285 formed therein to provide the flow passages of the upper evaporator 226. The lower portion 286 of the housing 276 includes grooves 287 for providing the flow passages of lower evaporation section 228. The sleeve 280 has an interior bore which is sized to closely fit the main body portion 278, such that the grooves of the respective ones of the upper portion 282 and the lower portion 286 are sufficiently sealed for operation of the mechanical refrigeration unit 216. An outer condenser sleeve 288 and inner condenser sleeve 290 provide respective ones of the inner condenser section 222 and the outer condenser section 220 of the condenser 218. Grooves 292 are formed on the interior surface of the outer condenser section 288, and exterior grooves 294 are formed into the exterior peripheral surface of the inner condenser section 290 to provide flow paths for the inner, first condenser section 220 and the outer, second section of the condenser 218. The grooves 285, 287, 292 and 294 may be in the form of Acme type screw threads, may respectively comprise singular or a plurality of screws, may be aligned in a spiral, parallel or linear configuration, or aligned in an arrangement in which they connect between two flow headers, or such other arrangement for providing refrigerant flow paths for condensers and evaporator sections of mechanical refrigeration units.

The compressor 240 of FIG. 6 has an alternative push surface 295 to the pusher surface 248 of FIG. 5. The pusher surface 295 has a mounting stud 296 extending therefrom for passing through a slot 298 in the pusher arm 299 of the lower portion of the alternative grip 275. A nut 300 then secures the mounting stud 296 within the slot 298. It should be noted that the mounting stud 296 slidingly engages the slot 298 during operation of the lever section 274 to reciprocate the pusher arm 272 to compress and release the bellows 242.

Figure 7:
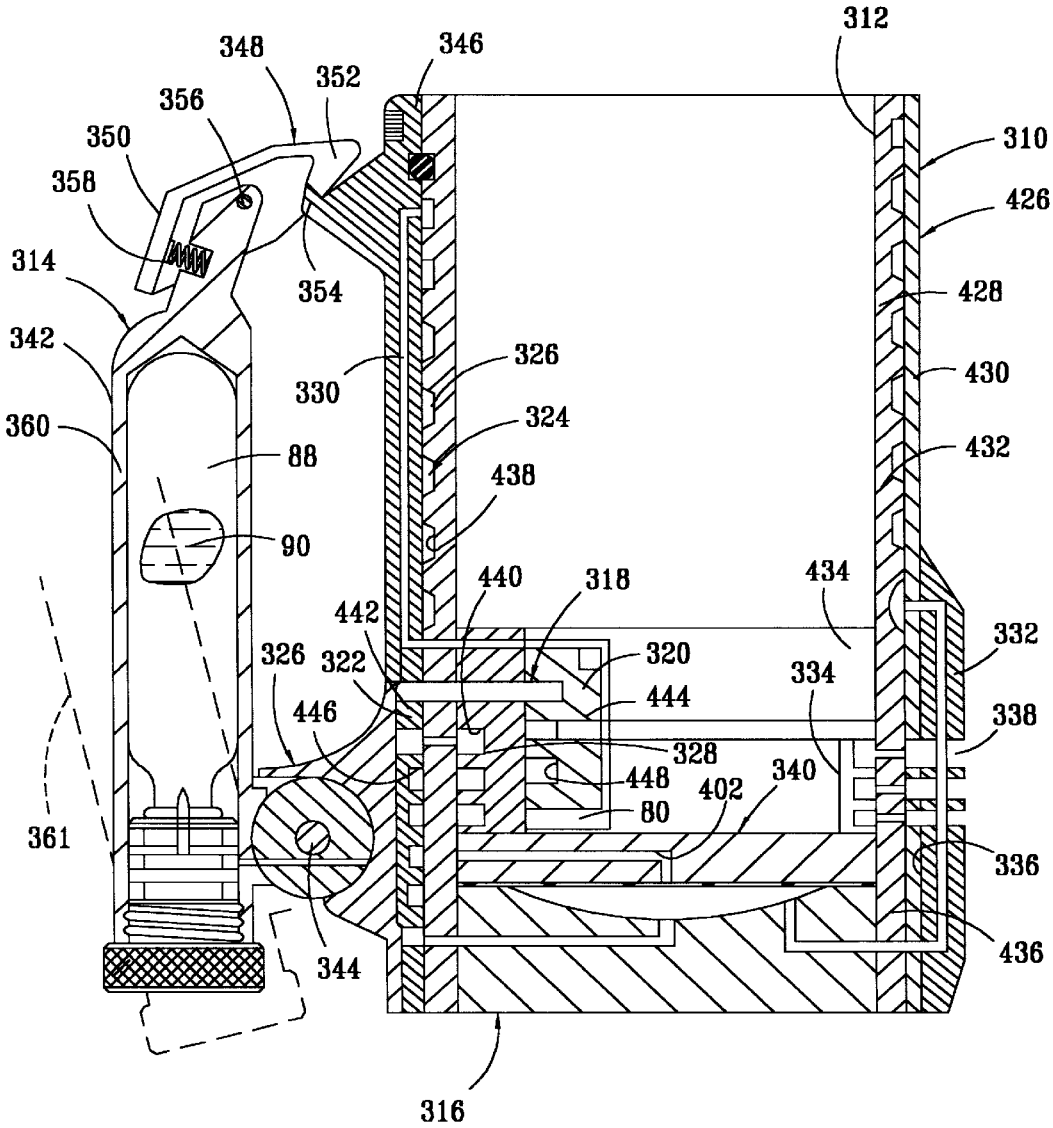
FIG. 7 illustrates a longitudinal section view of a refrigerated beverage mug of a second alternative embodiment of the present invention.

Referring now to FIG. 7, there is illustrated longitudinal section view of an alternative refrigerated beverage mug 310. The refrigerated beverage mug 310 has a beverage compartment 312 in which a beverage 14 (shown in FIG. 1) may be placed either directly or while being contained within a conventional beverage container 16 (shown in FIG. 1), such as an aluminum can, which contains the beverage 14. The beverage compartment 312 is sized for receiving the beverage container 16, such that walls of the beverage compartment 312 closely fit against the exterior of the beverage container 16 for absorbing heat transferred therefrom. The refrigerated beverage mug 310 has an actuator handle 314 and a mechanical refrigeration unit 316. The mechanical refrigeration unit 316 is a closed loop type refrigeration system, similar to the mechanical refrigeration units 30 and 216 of the refrigerated beverage mugs 10 and 210, which are shown in FIGS. 1 and 5, respectively. The mechanical refrigeration unit 316 includes a condenser 318 having a first inner condenser section 320 and a second outer condenser section 322. An evaporator 324 has an upper evaporator section 326. An expansion flow passage 330 is provided for interconnecting the condenser 318 to the evaporator 324. An outer cover 332 extends around the condenser 318, and the refrigerated beverage mug 310 has a lower cavity 334 which has vertical flow ports 336 and horizontal flow ports 338 for passing ambient around the inner first condenser section 320. Preferably, alcohol is used as a refrigerant 80 for circulating through the mechanical refrigeration unit 316. The refrigerated beverage mug 310 is substantially similar to the refrigerated beverage mugs 10 and 210, except that the actuation handle 314 and a compressor 340 are used with the refrigerated beverage 310. The components of the beverage mug 310 are formed to integrally provide components of the mechanical refrigeration unit 316, and are similar to those of the refrigerated beverage mugs 10 and 310, except for changes in positioning of flow passages and flow ports to accommodate the power source provided by the actuator handle 314 and the compressor 340.

The actuation handle 314 is an actuation member which is manually operated to provide actuation of a power source for powering the compressor 340 of the mechanical refrigeration unit 316. The actuation handle 314 includes a grip 342 which provides a hand grip when utilizing the refrigerated beverage mug 310, both for holding the mug during use to consume the beverage 14 and for use as a lever arm for operating to actuate the power source for powering the compressor 340 to power the mechanical refrigeration unit 216. The grip 342 is connected by a pivot pin 344 to the lower end of a handle mounting member 346. A latch 348 is provided on the upper end of the grip 342. The latch 348 includes a thumb tab 350 having a clasp 352 disposed on one end thereof. The clasp 352 engages a catch shoulder 354 of the latch 348 formed into the upper end of the handle mounting member 346. A pivot pin 356 connects the thumb tab 350 to the upper end of the grip 342. A bias spring 358 urges one end of the thumb tab 350 outward, such that the clasp 352 will remain engaged with catch shoulder 354 during use. The handle provides a lever arm 360 for pivoting around the pivot pin 355 to the position 361 (shown in phantom) operate a power section 362. The power section 362 is located in the handle 314.

Figure 8:
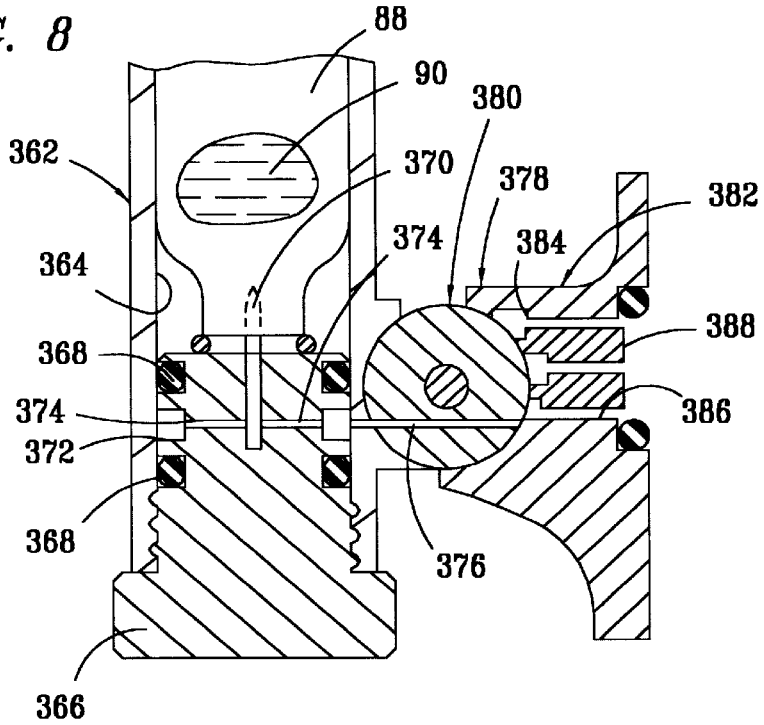
FIG. 8 illustrates a partial, longitudinal section view of a power section of the refrigerated beverage mug of FIG. 7.

Referring now to FIG. 8, there is illustrated a partial, longitudinal section view of the power section 362. The power section 362 includes a chamber 364 for retaining a cartridge 88 of a pressurized, expansible gas fluid 90, such as liquid nitrogen or carbon dioxide, which provides a power source for operating the compressor 340. The chamber 364 is sealed with a plug 366, having two O' ring seals 368. A tube 370 extends from an upward end of the plug 366, having a pointed, upper terminal end for passing through an elastomeric seal of the cartridge 88. The tube 370 is hollow and is connected to a circumferentially extending groove 372 formed into the exterior of the circumference of the plug 366 by flow ports 374. The groove 372 is disposed between the two O'rings 368, such that when the plug 366 is fully inserted within the chamber 364, the groove 372 is aligned with a pressure flow port 376 for passing pressurized fluid from within the cartridge 88 to the pressure flow port 376. The chamber 364 is sized such that insertion of the plug 366 into a threaded engagement with the bottom of the chamber 364 causes the tube 370 to be inserted through the elastomeric seal and into fluid communication with the interior of the cartridge 88.

The power section 362 further includes a valving section 378, having two arcuately shaped valving members 380 and 382. The arcuately shaped valving member 380 has convex shaped surface which fits flush against a concave shaped surface of the arcuately shaped valve member 382, with a slight interference fit, such that the arcuate member 380 will sealing engage arcuate member 382 such that only an insubstantial flow of the pressurized gas will pass from through the sealing engagement between the convex and the concave arcuate surfaces. One of the arcuately shaped valve members may be formed of an elastomeric material to provide a seal with the other of the arcuately shaped valve members. The arcuate valve member 380 includes the pressure flow port 376. The flow port 376 is aligned for sequentially connecting to three recesses 384 formed into the concave surface of the valve member 382, which are connected by three flow passages 386 to a single recess 388 disposed on the inward side of the valve member 382 for passing the pressurized fluid 90 to the compressor 340. Rotation of the arcuately shaped valve member 380 within the arcuately shaped valve member 382 will sequentially align the flow port 376 with various ones of the three recesses 384 for passing the pressurized fluid 90 therebetween.

Figure 9:
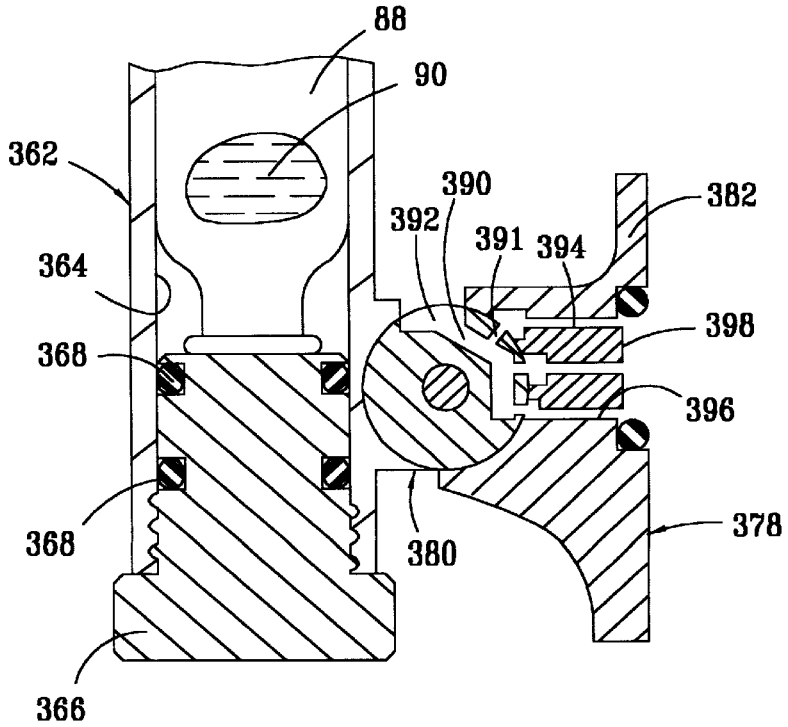
FIG. 9 illustrates a partial, longitudinal section view of a power section of the refrigerated beverage mug of FIG. 7.

Referring now to FIG. 9, there is illustrated a partial, longitudinal section view of the power section 362, taken along a sectioning plane which is parallel to and spaced apart from the sectioning plane of FIG. 8. The arcuate valve member 380 further includes a discharge flow port 390, which is connected to a discharge port 392. The flow port 390 connected to three flow passages 391 which are aligned for sequentially aligning with three recesses 394 formed into the concave surface of the valve member 382, which are connected by flow passages 396 to a single recess 398 disposed on the inward side of the valve member 382 for passing the pressurized fluid 90 discharged from the compressor 340 through the discharge flow port 390 and to the atmosphere. Rotation of the arcuately shaped valve member 380 within the arcuately shaped valve member 382 will sequentially align the flow passages 391, which are connected to the discharge flow port 390, with various ones of the three recesses 394 for sequentially passing the pressurized fluid 90 therebetween.

Figure 10:
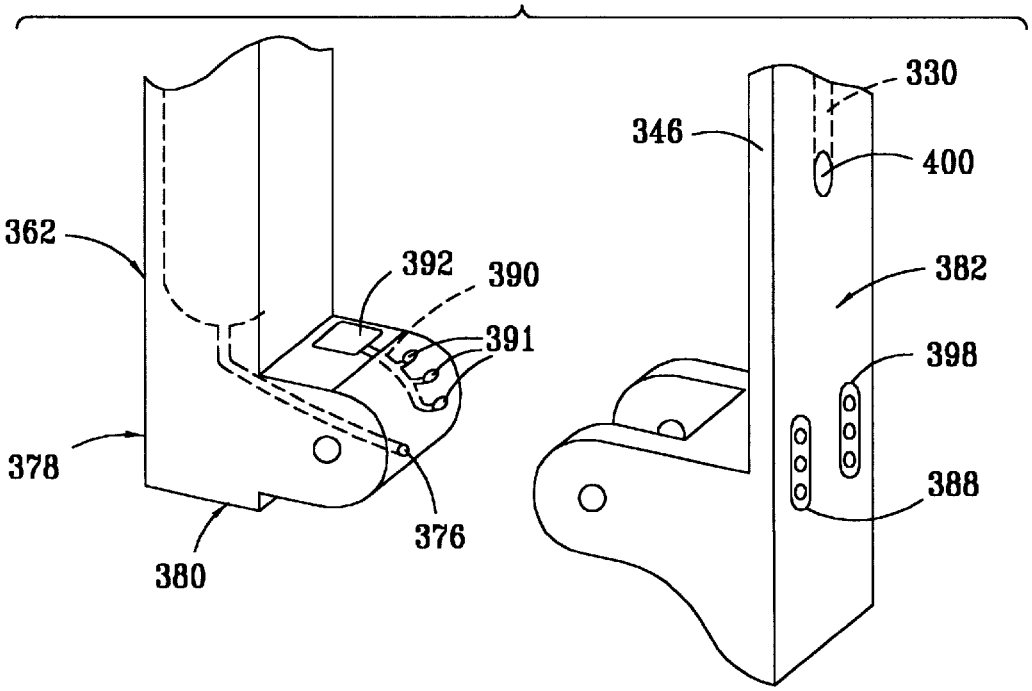
FIG. 10 illustrates an exploded view of a valving section of the refrigerated beverage mug of FIG. 7.

Referring now to FIG. 10, there is illustrated a partial, exploded view of the power section 362, depicting the valving section 378. The discharge port 390 is spaced apart from the pressure flow port 376, and the three recesses 394 (not shown) are spaced apart from the three recesses 384 (not shown). The flow port 376 and the flow ports 391, which are connected to the flow port 390, are sequentially aligned relative to one another and to respective ones of the recesses 384 and 394 in alternate fashion, such that the flow port 376 will not be aligned with one of the recesses 384 when the flow ports 391 are aligned with one of the recesses 394. This provides that one crank of the lever arm 360 on one angular direction will provide three cycles of operation of the compressor 340 to compress the refrigerant 80. A full downward and then upward pull to fully cycle the lever arm 360 will thus result in six strokes of the compressor 340. More than three of the recesses 384 and 394 may be provided to vary the ratio of compressor cycles to cranks of the lever arm. A second recess 400 is provided for connecting the compressor 340 to the evaporator tube 330 for passing refrigerant 80 to the evaporator tube 330.

Figure 11:
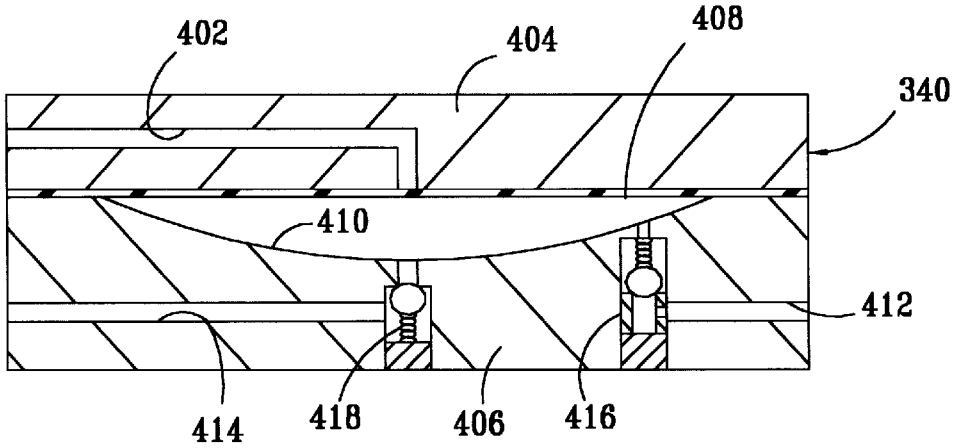
FIG. 11 illustrates a sectional view of a compressor for use in the refrigerated beverage mug of FIG. 7.

Referring now to FIG. 11, there is illustrated a sectional view of the compressor 340. The compressor 340 includes an upper housing 404 and a lower housing 406 with a flexible diaphragm member 408 extending therebetween. The diaphragm member 408 is preferably formed of elastomeric materials. A single flow port 402 is sequentially connected to the recesses 388 and 398 of the valving section 378 to alternately apply pressure pulses and then discharge the pressure from the compressor 340 to power the compressor 340. An arcuately shaped cavity 410 is formed into the upper surface of the lower housing 406 to form a pump chamber. An inlet flow passage 412 and an outlet flow passage 414 provide a flow passage for the refrigerant 80 to pass into the pressure chamber 410, and then to flow outward from within the pressure chamber 410 when the pressurized gas 90 is applied through flow passage 402 to the top of the diaphragm 408. Two spring biased ball check valves 416 and 418 are provided for respective ones of the flow ports 412 and 414 to control the direction of flow of the refrigerant 80 through the compressor 340 in respective ones of the flow pass 412 and 414.

Referring again to FIG. 7, the refrigerated beverage mug 310 includes a housing 426 having a main body section 428 and an outer sleeve 430 which fits closely over the main body section 428. The main body section 428 has a cup sized for receipt of a standard size beverage container 16, such as an aluminum can. The main body section 428 of the housing 426 includes an upper cup portion 432, an intermediate portion 434 and a lower portion 436. The exterior surface of the upper portion 432 of the housing 426 has grooves 438 formed therein to provide the flow passages of the upper evaporator 326. The lower portion 436 of the housing 426 includes grooves 440 for providing flow passages of a condenser section 328. The sleeve 430 has an interior bore which is sized to closely fit the main body portion 428, such that the grooves 438 and 440 of the respective ones of the upper portion 432 and the lower portion 436 are sufficiently sealed for operation of the mechanical refrigeration unit 316. The sleeve 430 may also have O' ring seals (not shown) on the opposite longitudinal ends of the sleeve 430. An outer condenser sleeve 442 and inner condenser sleeve 444 provide respective ones of the outer condenser section 322 and the inner condenser section 320 of the condenser 318. Grooves 446 are formed on the interior surface of the outer condenser section 442, and exterior grooves 448 are formed into the exterior peripheral surface of the inner condenser section 444 to provide flow paths for the inner, first condenser section 320 and the outer, second section 322 of the condenser 318. The grooves 438, 440, 446 and 448 may be in the form of Acme type screw threads, may respectively comprise singular or a plurality of screws, may be aligned in a spiral, parallel or linear configuration, or aligned in an arrangement in which they connect between two flow headers, or such other arrangement for providing refrigerant flow paths for condensers and evaporator sections of mechanical refrigeration units.

In operation, a beverage 14 is placed within the beverage compartment 312, either directly within the beverage compartment 312 or within a beverage container 16, which is placed within the beverage compartment 312. When cooling of the beverage 14 is desired the thumb tab 350 will be depressed to release the clasp 352 from the latch shoulder 354. Then, the refrigerated beverage mug 310 may be gripped in one hand of the user, and the grip 342 of the lever arm 360 may be gripped in the other hand of the user. The lever section 360 will be pulled in a first angular direction, such that the clasp 352 is separated from the catch shoulder 354, and then the lever section 360 will be pushed in an opposite angular direction to the first angular direction, such that the clasp 352 is moved closer to the latch shoulder 354. Moving the actuator member 314 releases the expansible fluid 90 from within the cartridge canister 88 to power the compressor 340 of the mechanical refrigeration unit 316. Angular displacement of the lever arm 360 relative to the pivot pin 355, such that the recesses 384 are selectively aligned with the flow ports 376, and the recesses 394 are selectively aligned with the flow ports 391, in sequential fashion, that is at different times, such that pressure pulses are selectively applied to the pressure passage 402 to of the diaphragm 408. This causes the compressor 340 to cycle as the lever arm 360 is stroked, compressing the refrigerant 80 for movement through the refrigeration unit 316. Powering the compressor 340 causes the compressor 340 to circulate the refrigerant 80 through the condenser 318, through the expansion flow passage 330, into the evaporator 324 and back into the compressor 340. The refrigerant 80 will pass through the evaporator 324, cooling the beverage 14 disposed within the beverage compartment 12. The expansible fluid 90 is released from the compressor 340, passes through flow ports 336, and passes across an inner, second condenser section 320 to remove heat from the condenser section 320. The moving of the lever action will be repeated until the beverage 14 is cooled to a sufficiently low temperature for consumption. The refrigerated beverage mug 310 may be used to cool the beverage 14 from ambient temperatures to desire temperatures, such as forty degrees Fahrenheit and below.

Although the preferred and alternative embodiments have been described in detail, it should be understood that various changes, substitutions and alterations can be made therein without departing from the spirit and scope of the invention as defined by the appended claims.

What is claimed is:

1. A refrigerated beverage mug, comprising:

a hand-held beverage mug which includes a housing having a beverage compartment of a size for holding a volume of a beverage for consumption by a singular person;

a self-contained mechanical refrigeration unit having a compressor, an expansion passage, an evaporator and a condenser which are connected together to define a closed loop system;

said refrigeration unit being mounted to said housing with said condenser in thermal communication with ambient air for transferring heat thereto, said expansion passage in fluid communication between said condenser and said evaporator, and said evaporator in thermal communication with said beverage compartment for absorbing heat therefrom;

a power source mounted to said housings such that said power sourced is mounted onboard said refrigerated beverage mug and operable for providing power to said mechanical refrigeration unit to drive said compressor; and wherein said refrigeration unit is selectively operable for cooling the beverage within said beverage compartment upon demand by the singular person consuming the beverage directly from said beverage mug.

2. The refrigerated beverage mug of claim 1, wherein said evaporator is integrally formed with the beverage compartment of said housing.

3. The refrigerated beverage mug of claim 2, wherein said housing includes a main body section having an open upper end and a base, and said condenser is integrally formed with said base of said housing.

4. The refrigerated beverage mug of claim 3, wherein said evaporator and said condenser have evaporator and condenser flow paths, respectively, which are formed into sidewalls of said housing by forming grooves into surfaces of said sidewalls of said housing, and then closely fitting respective members of said housing adjacent to said grooves to prevent significant leakage of refrigerant from said grooves for operation of said refrigeration unit.

5. The refrigerated beverage mug of claim 1, wherein said power source comprises a pressurized, expansible fluid which is expanded to drive said compressor and operate said mechanical refrigeration system.

6. The refrigerated beverage mug of claim 5, wherein said expansible fluid, after discharge from said compressor, is passed across a portion of said condenser and absorbs heat from said condenser.

7. The refrigerated beverage mug of claim 6, wherein said expansible fluid, when pressurized, comprises a liquified gas.

8. The refrigerated beverage mug of claim 1, wherein said power source comprises a hand-powered lever arm which a user operates to power said compressor and move a refrigerant through said condenser, said expansion passage and said evaporator.

9. A refrigerated beverage mug, comprising:

a housing having a beverage compartment for holding a beverage;

a self-contained mechanical refrigeration unit having a compressor, an expansion passage, an evaporator and a condenser which are connected together to define a closed loop system;

said mechanical refrigeration unit being mounted to said housing with said condenser in thermal communication with ambient air for transferring heat thereto, said expansion passage in fluid communication between said condenser and said evaporator, and said evaporator in thermal communication with said beverage compartment for absorbing heat therefrom; and a power source mounted to said housing such that said power source is mounted onboard said refrigerated beverage mug, and containing a pressurized, expansible fluid for releasing to power to said mechanical refrigeration unit and thereby drive said compressor.

10. The refrigerated beverage mug of claim 9, wherein said expansible fluid, after discharge from said compressor, is passed across a portion of said condenser and absorbs heat from said condenser.

11. The refrigerated beverage mug of claim 10, wherein said expansible fluid, when pressurized, comprises a liquified gas.

12. The refrigerated beverage mug of claim 9, wherein said compressor comprises:

a first housing section which defines a pressure chamber;

a second housing section which defines a pump chamber having a concave shape;

a flexible diaphragm sealingly extending between said pressure chamber and said pump chamber;

a control head for, at least in part, controlling a flow of said expansible fluid through said pressure chamber;

inlet and outlet valves for controlling a flow of a refrigerant into said pump chamber and from said pump chamber, respectively; and wherein passage of said expansible fluid from within said pressure chamber causes said refrigerant to flow into said pump chamber, and passage of said expansible fluid into said pressure chamber causes compression of said refrigerant and the flow of said refrigerant from said pump chamber.

13. The refrigerated beverage mug of claim 9, wherein said refrigeration unit is selectively operable for cooling the beverage within said beverage compartment upon demand.

14. The refrigerated beverage mug of claim 9, wherein said housing is hand-held and further comprises:

a handle which defines a hand-grip for a person to grasp said housing;

said handle having an interiorly disposed chamber for receiving a cannister of said expansible fluid; and said handle having an actuation member for the person to operate to selectively cause said expansible fluid to flow from within said cannister to power said compressor.

15. The refrigerated beverage mug of claim 9, wherein said housing includes a main body section having an open upper end and a base, and said condenser is integrally formed with said base of said housing.

16. The refrigerated beverage mug of claim 9, wherein said evaporator and said condenser have evaporator and condenser flow paths, respectively, which are formed into sidewalls said housing by forming grooves into surfaces of said housing, and then dispose adjacent to closely fitting members of said housing which abut said grooves to prevent significant leakage of refrigerant from said grooves for operation of said refrigeration unit.

17. A refrigerated beverage mug, comprising in combination:

a hand-held beverage mug which includes a housing having a beverage compartment of a size for holding a volume of a beverage for consumption by a singular person;

a self-contained mechanical refrigeration unit having a compressor, an expansion passage, an evaporator and a condenser;

said refrigeration unit being mounted to said housing with said condenser in thermal communication with ambient air for transferring heat thereto, said expansion passage in fluid communication between said condenser and said evaporator, and said evaporator in thermal communication with said beverage compartment for absorbing heat therefrom;

said evaporator and said condenser being integrally formed into sidewalls of said housing to define evaporator and condenser flow paths, respectively, said evaporator and condenser flow paths being integrally formed into said sidewalls of said housing by forming grooves into surfaces of said housing, and then closely fitting members of said housing adjacent to said grooves to prevent significant leakage of a refrigerant fluid from said grooves for operation of said refrigeration unit;

a common heat exchanger section in which a portion of said evaporator is in thermal communication with part of said condenser for transferring heat from said condenser to said evaporator;

said housing having a handle which defines a hand-grip for a person to grasp said housing, and which includes an interiorly disposed chamber for receiving a cannister of a pressurized, expansible fluid;

an actuation member mounted to said handle for the person to operate to selectively cause said expansible fluid to flow from within said cannister to power said compressor and thus to selectively operate said refrigeration unit to for cooling the beverage within said beverage compartment upon demand by the singular person consuming the beverage directly from said beverage mug;

said compressor having a pressure chamber, a pump chamber having a conical, concave shape, a flexible diaphragm sealingly extending between said pressure chamber and said pump chamber, a control head for, at least in part, controlling a flow of said expansible fluid through said pressure chamber, and inlet and outlet valves for controlling a flow of said refrigerant fluid into said pump chamber and from said pump chamber, respectively;

wherein passage of said expansible fluid from within said pressure chamber causes said refrigerant fluid to flow into said pump chamber, and passage of said expansible fluid into said pressure chamber causes compression of said refrigerant fluid and the flow of the refrigerant fluid from said pump chamber; and wherein said expansible fluid, after discharge from said compressor, is passed across a portion of said condenser and absorbs heat from said condenser.

18. A method for consuming a beverage from a refrigerated beverage mug, comprising the steps of:

providing a beverage mug having a beverage compartment, a self-contained mechanical refrigeration unit and a power source mounted onboard the beverage mug for operatively powering the mechanical refrigeration, the mechanical refrigeration unit defining a closed loop system through which a refrigerant is circulated to remove heat from the beverage compartment and transfer the heat to ambient air proximate to the beverage mug;

holding the beverage mug with one hand;

placing a beverage in the beverage compartment of the beverage mug;

selectively actuating the power source to operate the mechanical refrigeration unit;

circulating the refrigerant through portions of the beverage mug, which transfers heat from the beverage compartment to the ambient air proximate to the beverage mug and thereby reduces the temperature of the beverage within the beverage compartment to a desired temperature for consumption;

consuming the beverage directly from the beverage compartment of the refrigerated beverage mug wherein the step of selectively actuating the power source to operate the mechanical refrigeration unit comprises the steps of:

selectively releasing a pressurized expansible fluid from within an onboard storage chamber of the beverage mug into a flow passage which is in fluid communication with a compressor of the mechanical refrigeration unit; and then passing the expansible fluid through the flow passage and the compressor of the mechanical refrigeration unit to power the compressor which circulates the expansible fluid through the portions of the beverage mug.

19. The method of claim 18, further comprising:

after the step of passing the expansible fluid through the compressor of the mechanical refrigeration unit, passing the expansible fluid over a condenser of the mechanical refrigeration unit.

* * * * *